US006349278B1

(12) United States Patent
Krasny et al.

(10) Patent No.: US 6,349,278 B1
(45) Date of Patent: Feb. 19, 2002

(54) SOFT DECISION SIGNAL ESTIMATION

(75) Inventors: Leonid Krasny, Cary, NC (US); Soontorn Oraintara, Boston; Truong Nguyen, Burlington, both of MA (US)

(73) Assignee: Ericsson Inc., Research Triangle Park, NC (US)

( * ) Notice: Subject to any disclaimer, the term of this patent is extended or adjusted under 35 U.S.C. 154(b) by 0 days.

(21) Appl. No.: 09/368,596

(22) Filed: Aug. 4, 1999

(51) Int. Cl.[7] ..... G10L 21/02
(52) U.S. Cl. ..... 704/233; 704/226
(58) Field of Search ..... 704/200, 201, 704/226, 227, 228, 233

(56) References Cited

U.S. PATENT DOCUMENTS

| | | | | | |
|---|---|---|---|---|---|
| 5,012,519 | A | * | 4/1991 | Adlersberg et al. | 381/47 |
| 5,251,263 | A | * | 10/1993 | Andrea et al. | 381/71 |
| 5,511,009 | A | | 4/1996 | Pastor | 364/572 |
| 5,577,161 | A | * | 11/1996 | Pelaez | 704/226 |
| 5,630,015 | A | | 5/1997 | Kane et al. | 704/226 |
| 5,768,473 | A | | 6/1998 | Eatwell et al. | 704/226 |
| 5,839,101 | A | * | 11/1998 | Vahatalo et al. | 704/226 |
| 5,918,204 | A | * | 6/1999 | Tsurumaru | 704/214 |
| 5,974,373 | A | * | 10/1999 | Chan et al. | 704/200 |
| 6,023,674 | A | * | 2/2000 | Mekuria | 704/233 |

FOREIGN PATENT DOCUMENTS

EP 0784311 A1 11/1996 ..... G10L/3/00

OTHER PUBLICATIONS

ICASSP–95. George, "Single sensor speech enhancement using a soft decision.variable attenuation algorithm" pp. 816–819 vol. 1 May 1995.*

1998 URSI International Synposium on Signals, Systems and Electronics. Ibrahim et al., "Iterative decoding and soft interference cancellation for the Gaussian multiple access channell" pp. 156–161. Oct. 1998.*

"Speech Enhancement Using a Soft–Decision Noise Suppression Filter" by Robert J. McAulay, Member, IEEE, and Marilyn L. Malpass—IEEE Transactions On Acoustics, Speech, and Signal Processing, vol. ASSP–28, No. 2, Apr. 1980.

Sohn, Jongseo and Sung, Wonyong; "A Voice Activity Detector Employing Soft Decision Based Noise Spectrum Adaptation"; IEEE, 6/98, pp. 365–368. Dec. 1998.

* cited by examiner

*Primary Examiner*—Richemond Dorvil
(74) *Attorney, Agent, or Firm*—Coats & Bennett, P.L.L.C.

(57) ABSTRACT

A method for signal detection uses a likelihood ratio derived from the received signal to produce an estimate of a speech signal that has been corrupted by noise during transmission. The received signal is input to a receiver filter and a voice-activity detector. The receiver filter filters the received signal to produce a filter output signal. The voice-activity detector generates a likelihood ratio based on the received signal, which is then used to produce a speech-probability estimate indicating the probability that the received signal includes a speech signal. The filter output signal is combined with the speech-probability estimate output from the voice-activity detector to generate a soft estimate of the original speech signal.

24 Claims, 5 Drawing Sheets

SOFT DECISION SIGNAL ESTIMATION

FIELD OF THE INVENTION

The present invention relates generally to a method for estimating a speech signal in the presence of noise and, more particularly, to soft decision signal estimation method for generating a soft estimate of a speech signal contained in a received signal.

BACKGROUND OF THE INVENTION

One function of the digital communication system is to transmit a speech signal from a source to a destination. The speech signal is often corrupted by noise which complicates and degrades the performance of coding, detection, and recognition algorithms. This problem is particular severe in mobile communication systems where numerous common sources of noise exist. For example, common noise sources in a mobile communication system include engine noise, background music, environmental noise (such as noise from an open window), and background speech from other persons. The efficiency of coding and recognition algorithms depends on being able to efficiently and accurately estimate both the speech and noise components of a received signal. There are many approaches presented in the literature to solve this problem. Among those, spectral subtraction is one of the most popular techniques because the speech signal is quasi-stationary, and the algorithm can be implemented efficiently using the Fast Fourier Transform (FFT).

The spectral subtraction method for signal estimation is based on the assumption that speech is present. When transmitted over the communication channel, the speech signal is corrupted by noise. The signal observed at the receiving end is the mixture of the speech signal and noise signal. The received signal is filtered in the frequency domain by a filter, such as a matched filter, that attempts to minimize the noise component in the received signal. The output of the matched filter is the estimate of the speech signal based on the assumption that speech was transmitted.

A filter commonly used in a signal detector is a Wiener filter, which minimizes the mean square error between the transmitted speech signal and the signal estimate. The Wiener filter uses the power spectral density (PSD) of the speech signal and noise signal to produce an estimate of the speech signal. Because the speech and noise signals are combined in the received signal, it is generally not possible to calculate the power spectral density of the speech signal and noise signal simultaneously. However, in a voice communication system, such as a mobile communication system, the speech signal is not present at all times. Thus, the power spectral density of the noise signal can be estimated during the time that the speech is absent. Assuming that changes in the noise signal are slow, the power spectral density of the speech signal can be calculated during the time that speech is present by subtracting the power spectral density of the noise signal (calculated when speech was not present) from the power spectral density of the received signal. This technique for calculating the power spectral density of the speech signal assumes that the speech signal and noise signal are independent, which is not always correct.

In order to estimate the power spectral density of the noise signal and speech signal, a voice activity detector (VAD) is used to detect the presence of speech in the received signal. In a conventional VAD, the received signal input to the VAD is filtered, squared, and summed in order to measure the power of the signal during a given time period. The VAD produces an estimate $\hat{\theta}$ indicating whether speech is present. In a conventional detector, a hard decision is made, meaning that $\hat{\theta}$ takes on a value of 1 when speech is present and a value of 0 when speech is not present. The output of the Wiener filter is multiplied by $\hat{\theta}$. Consequently, a final estimate of the speech signal $\hat{s}(k)$ is output only when $\hat{\theta}$ equals one. This method of signal estimation is known as hard decision estimation.

In hard decision signal estimation, errors made by the voice activity detector can result in significant error in final estimate of the speech signal. For example, assume that a signal containing speech is received but is not detected by the voice activity detector. In this case, the speech signal will not be output from the signal detector.

Soft decision signal estimation was explored in R J McAulay and M L Loupes, SPEECH ENHANCEMENT USING A SOFT DECISION NOISE SUPPRESSION FILTER, *IEEE. Trans. in Acoustics Speech and Signal Processing,* ASSB-28:137–145, 1980. This article describes a signal estimation technique where the estimate $\hat{\theta}$ is not restricted to 1 or 0, but can be any number in the range 0 to 1. However, the soft decision signal estimation technique described in the article is based on the assumption that the speech signal is a deterministic signal with unknown magnitude and phase. In fact, speech is a random process so the model to estimate the speech signal is not appropriate. Therefore, the signal estimation technique described in the article is not optimal for detection of a speech signal.

SUMMARY OF THE INVENTION

The present invention is a soft decision signal estimation algorithm for generating an estimate of a speech signal from a received signal containing both speech and noise components. The received signal is converted to the frequency domain by a Fast Fourier Transform (FFT). In the frequency domain, the received signal is filtered by a Wiener filter to eliminate, as much as possible, the noise component of the signal. The output signal from the Wiener filter is converted back to the time domain by an inverse FFT. The output signal from the Wiener filter is then combined in the time domain with a speech probability estimate generated by a voice activity detector (VAD) to obtain a soft estimate of the speech signal.

A voice activity detector is used to compute the speech probability estimate. In conventional signal estimation, the VAD detects whether the received signal contains a speech component and outputs a hard decision (i.e. 0 or 1). In the present invention, the VAD generates a soft estimate of the probability of speech, called the speech probability estimate, that is combined with the output of the Wiener filter to obtain a soft estimate of the speech signal. To compute the speech probability estimate, the VAD computes a likelihood ratio based on the received signal. The likelihood ratio and the a priori probability of speech are used to compute the speech probability estimate. The likelihood ratio is also used to determine when to update the frequency response of the Wiener filter and VAD filter.

DETAILED DESCRIPTION OF THE INVENTION

Figure 1:
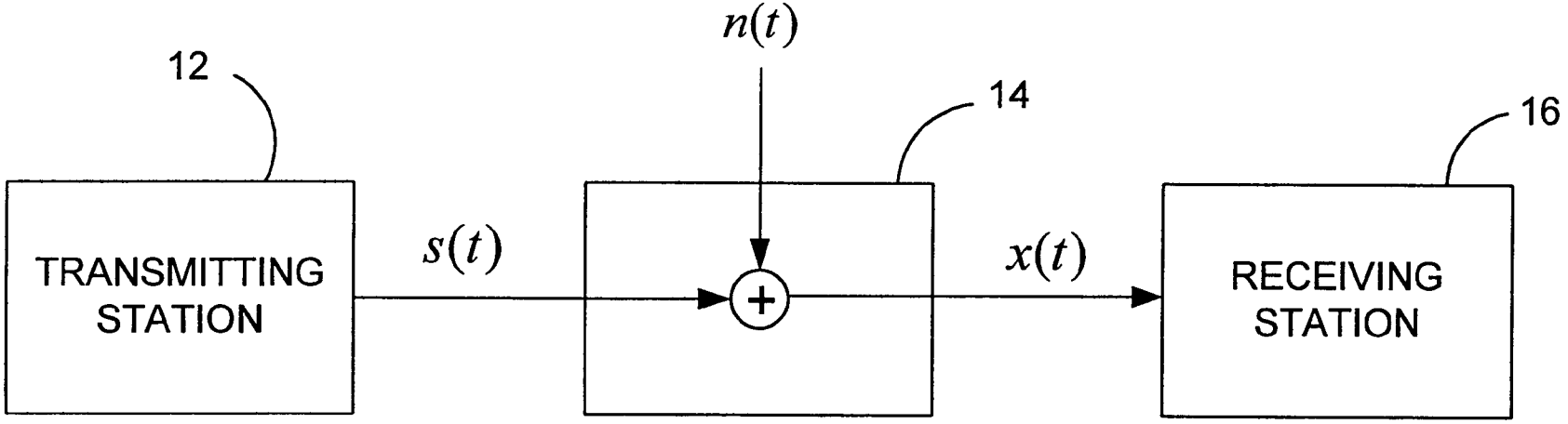
FIG. 1 is a block diagram of a communication system.

FIG. 1 is a block diagram illustrating a model of a voice communication system. A voice signal s(k) is transmitted from a transmitting station 12 over a communication channel 14 to a receiving station 16. The channel 14 is assumed to corrupt the signal by the addition of Gaussian noise, n(k). The system is assumed to be linear. Therefore, the observed signal x(k) at the receiving station 16 is a linear combination of the voice signal s(k) and the noise signal n(k). Since speech is not present at all times during a transmission, the observed signal x(k) can be modeled as follows:

$$x(k)=\theta\cdot s(k)+n(k) \qquad \text{Eq. (1)}$$

where θ indicates the presence of the signal s(k), and has a value of 1 if speech is present and a value of 0 if speech is not present.

Figure 2:
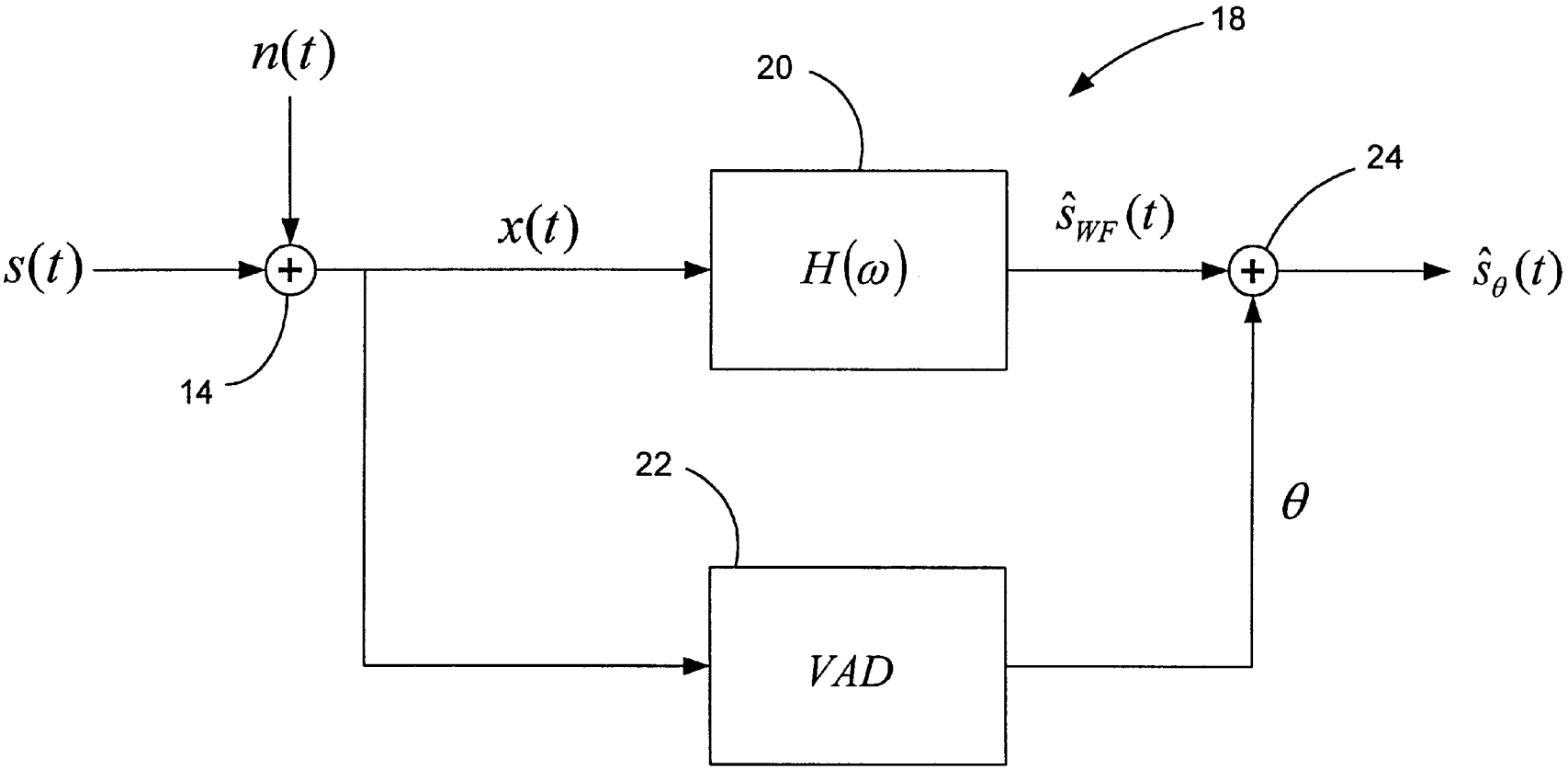
FIG. 2 is a block diagram of a signal detector in a receiving station.

FIG. 2 is a block diagram of a conventional signal detector for estimating the signal S(k) based on the received signal x(k). As shown in FIG. 2, a conventional signal detector 18 includes a matched filter 20 and voice activity detector (VAD) 22. The received signal x(k) is passed through the matched filter 20. The output of the matched filter 20 is the signal estimate ŝ(k) based on the assumption that the speech signal s(k) is present. The frequency response of the matched filter 20 is chosen based on some predetermined error criteria, which is well known in the art. For example, if it is designed to minimize the mean square error between the transmitted signal x(k) and the estimated signal ŝ(k), then the matched filter 20 corresponds to a Wiener filter having a frequency response H(ω) given by the following equation:

$$H(\omega)=H_{WF}(\omega)=\frac{\phi_s(\omega)}{\phi_s(\omega)+\phi_n(\omega)}, \qquad \text{Eq. (2)}$$

where $\phi_s(\omega)$ and $\phi_n(\omega)$ are respectively the power spectral density of s(k) and n(k). In order to calculate the frequency response H(ω), it is necessary to calculate $\phi_s(\omega)$ and $\phi_n(\omega)$. In general, $\phi_s(\omega)$ and $\phi_n(\omega)$ cannot be calculated simultaneously since only the combined signal x(k) is available. However, since the speech signal s(k) is not present at all times, $\phi_n(\omega)$ can be estimated during the time that speech is absent. Therefore, $\phi_s(\omega)$ can be calculated during the time that speech is present by subtracting the power spectral density $\phi_n(\omega)$ of the noise signal from the power spectral density $\phi_x(\omega)$ of the received signal x(k). When speech is present, the power spectral density $\phi_x(\omega)$ of the observed signal x(k) is calculated and the power spectral density $\phi_s(\omega)$ of the speech signal s(k) is obtained by the following equation:

$$\phi_s(\omega)=\phi_x(\omega)-\phi_n(\omega) \qquad \text{Eq. (3)}$$

The output of the filter 20 is input to a mixer 24. The output of the filter 20 is combined at the mixer 24 with a random variable θ output from the voice activity detector 22, where θ indicates the presence of speech.

Figure 3:
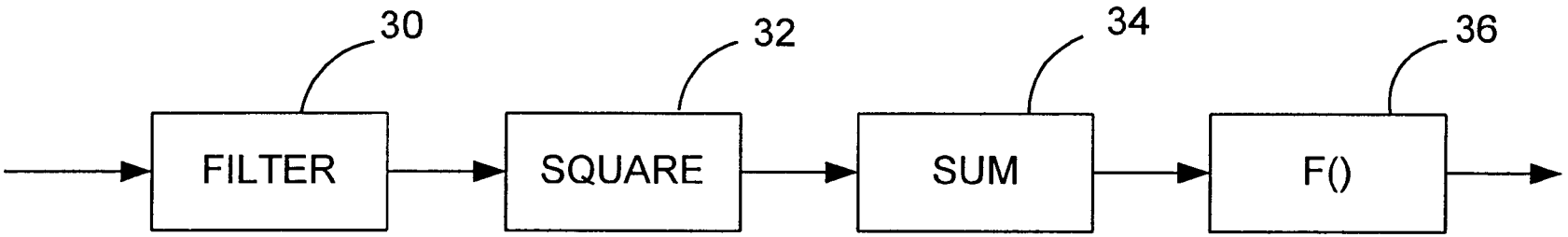
FIG. 3 is a block diagram of a voice activity detector.

FIG. 3 is a block diagram showing a voice activity detector used in a conventional signal detector. As shown in FIG. 3, the received signal x(k) is filtered by a VAD filter 30 with frequency response $H_{VAD}(\omega)$. The filter output y(t) is then squared and summed to obtain a measure of the energy at a time interval [0,T] of interest. The power of the signal is obtained by the following equation:

$$U_{VAD}=\int_0^T y^2(t)dt \qquad \text{Eq. (4)}$$

If $U_{VAD}$ exceeds a predetermined threshold $U_{TH}$, then a value of 1 is assigned to the speech probability estimate $\hat{\theta}$. Conversely, if the value of $U_{VAD}$ is less than the predetermined threshold $U_{TH}$, a value of 0 is assigned to the speech probability estimate $\hat{\theta}$. According to the conventional approach, one can see that the speech probability estimate $\hat{\theta}$ has only two values: 0 and 1.

As a final step in the signal estimation process, the output of the filter 20 is multiplied by the speech probability estimate $\hat{\theta}$ to obtain the estimate $\hat{s}_\theta(k)$ of the speech signal. Since $\hat{\theta}$ has only two values, an estimate $\hat{s}_\theta(k)$ of the speech signal is obtained only when the speech probability estimate $\hat{\theta}$ has a value of 1. When $\hat{\theta}$ is equal to 0, no signal is output from the detector 18.

On the present invention, the speech probability estimate $\hat{\theta}$ can take arbitrary values between 0 and 1. According to the present invention, a priori knowledge of the probability of speech is used to obtain a soft estimate $\hat{s}_\theta(k)$ of the speech signal s(k). The optimal estimate $\hat{s}_\theta(k)$ for the signal s(k) is given by the following equation:

$$\hat{s}_\theta=\int s\cdot p(s|x)ds=\int\int s\cdot p(s|\theta,x)p(\theta|x)d\theta ds=p(\theta=1|x)\int s\cdot p(s|\theta=1,x)ds \qquad \text{Eq.(5)}$$

The first term in Equation 5 ($p(\theta=1|x)$) is the optimal estimate of the random variable θ (in the sense of mean square criterion). This is referred to herein as the speech probability estimate $\hat{\theta}$ and is given by the following equation:

$$\hat{\theta}=p(\theta=1|x)=\int\theta\cdot p(\theta|x)d\theta \qquad \text{Eq. (6)}$$

The second term in Equation 5 ($\int s\cdot p(s|\theta=1,x)ds$) is the Wiener estimate of s(k), which is denoted herein as $\hat{s}_{WF}(k)$. The Wiener estimate of s(k) is given by the following equation:

$$\hat{s}_{WF}=\int s\cdot p(s|\theta=1,x)ds \qquad \text{Eq. (7)}$$

Substituting Equations 6 and 7 into Equation 5, the equation for the estimated speech signal $\hat{s}_\theta(k)$ can be written as follows:

$$\hat{s}_\theta(k)=\hat{\theta}\cdot\hat{s}_{WF}(k) \qquad \text{Eq. (8)}$$

The speech probability estimate $\hat{\theta}$ can be calculated using the a priori probabilities of speech according to the following equation:

$$\theta=\frac{p(x|0=1)\cdot p(\theta=1)}{p(x|\theta=0)\cdot p(\theta=0)+p(x|\theta=1)\cdot p(\theta=1)}=\frac{p_1\lambda(x)}{p_0+p_1\lambda(x)} \qquad \text{Eq. (9)}$$

where λ is a likelihood ratio describing the structure of the optimal voice activity detector, and $p_j=p(\theta=j)$ is the a priori probability for the speech variable θ. The likelihood ratio is defined as:

$$\lambda(x) = \frac{p(x|\theta = 1)}{p(x|\theta = 0)} \quad \text{Eq. (10)}$$

It is known that for Gaussian signal and noise, the likelihood ratio has a form:

$$\lambda(x) = \exp\{\tfrac{1}{2}[U_{VAD} - U_{TH}]\} \quad \text{Eq. (11)}$$

where $U_{VAD}$ is the power of the received signal and $U_{TH}$ is a predetermined threshold. The $U_{VAD}$ is given by Equation 4 where y(t) is the output of the VAD filter with the frequency response given by:

$$|H_{VAD}(\omega)|^2 = \frac{\phi_s(\omega)}{\phi_n(\omega)[\phi_s(\omega) + \phi_n(\omega)]} =: |H_{opt}(\omega)|^2 \quad \text{Eq. (12)}$$

The optimal VAD filter requires the power spectral density functions of both the speech signal and noise signal. However, this computation can be simplified by assuming that the signal to noise ratio (SNR) is high. Based on this assumption, Equation 12 becomes:

$$|H_{opt}(j\omega)|^2 \approx \frac{1}{\phi_n(\omega)} \quad \text{Eq. (13)}$$

It is noted that Equation 13 corresponds to a whitening filter and requires only the computation of $\phi_n(\omega)$. Using Equation 13, only the power spectral density of noise is needed in order to calculate the VAD filter which can be assumed to be available for two reasons: 1) the noise does not change quickly from frame to frame compared to speech, and 2) there are a large number of speech-free frames especially at the beginning when the system is turned on. Further, the mean variance, and thus the threshold function, is a constant given by the following equation:

$$U_{TH} = 2\Delta fT\left[1 + \frac{\phi^{-1}(1 - P_f)}{\sqrt{\Delta fT}}\right], \quad \text{Eq. (14)}$$

where $\Delta f$ is the effective band width, T is the time duration of one frame, $\phi$ is the error function, and $P_f$ is the false alarm probability.

Figure 4:
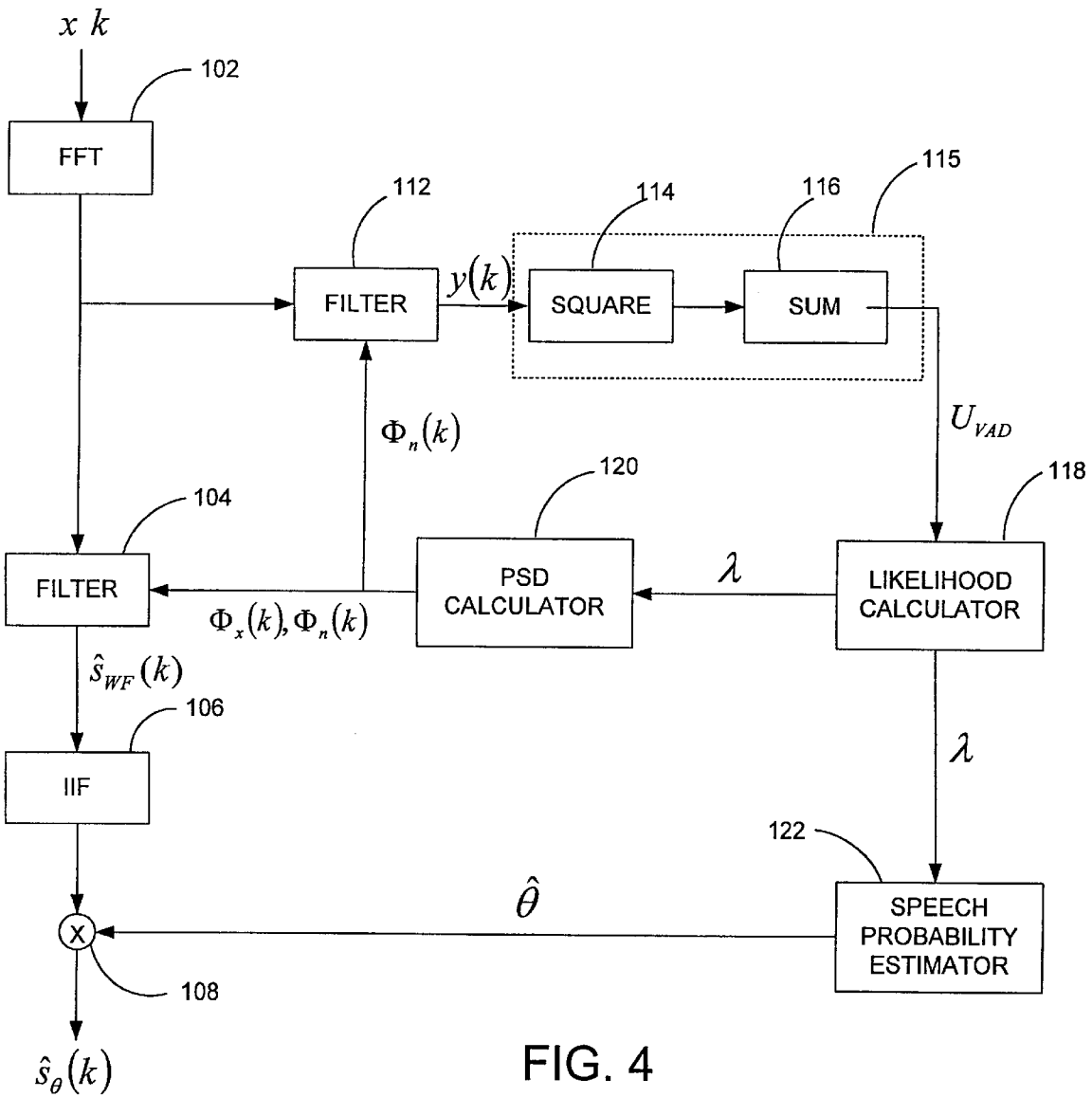
FIG. 4 is a block diagram of the soft decision signal detector of the present invention.

FIG. 4 is a block diagram illustrating the soft decision signal detector, which is indicated generally by the numeral 100. The signal detector 100 includes a Fast Fourier Transform function (FFT) to convert the received signal x(k) to the frequency domain. The received signal x(k) is input to both a Wiener filter 102 and voice activity detector (VAD) 110. The power spectral density values for the received signal and noise signal are input to the Wiener filter. In the preferred embodiment of the invention, the power spectral density values are computed and updated by the voice activity detector 110 as described in more detail below. The frequency response of the Wiener filter is calculated according to Equation 2 based on the power spectral density values input from the VAD 110.

The output of the Wiener filter (denoted $\hat{s}_{WF}(k)$) is input to an inverse Fast Fourier Transform (IFFT) function 106 which converts the signal back to the time domain. The signal is then input to a mixer 108. The other input to the mixer 108 is the output of the voice activity detector 110.

The voice activity detector 110 includes a VAD filter 112, which in the preferred embodiment is a whitening filter with a frequency response given by Equation 13. The received signal is input to the VAD filter 112. The output of the VAD filter 112 is fed to the input of a power detector 115 which consists of a squarer 114 and summer 116. The power detector 115 estimates the power $U_{VAD}$ of the signal output from the VAD filter 112 according to Equation 4. The power estimate $U_{VAD}$ is input to a likelihood estimator 118 that calculates the likelihood ratio $\lambda$ according to Equation 10. The likelihood ratio $\theta$ is input to the speech estimator 122 which generates the speech probability estimate $\hat{\theta}$. The speech probability estimate $\hat{\theta}$ from the speech probability estimator 122 is input to the mixer 108. The output of the mixer 108, which is determined by Equation 8 is the estimated signal $\hat{s}_\theta(k)$.

The likelihood ratio $\lambda$ is also input to a power density calculator 120 which calculates the power spectral density of the received signal x(t) and noise signal n(t) based on the received signal, The power density calculator uses the likelihood function $\lambda$ to determine whether to update the power spectral density functions. If the likelihood ratio $\lambda$ is greater than a predetermined threshold, denoted $\lambda_{TH}$, then the power spectral density function $\phi_x(k)$ for the received signal x(k) is updated. On the other hand, if the likelihood ratio $\lambda$ is less than or equal to the threshold $\lambda_{TH}$, the power spectral density function $\phi_n(k)$ of the noise signal n(k) is updated. The power spectral density functions of the received signal and noise signal are used to calculate the Wiener filter 104. The power spectral density function of the noise signal is also to calculate the VAD filter 112.

Figure 5:
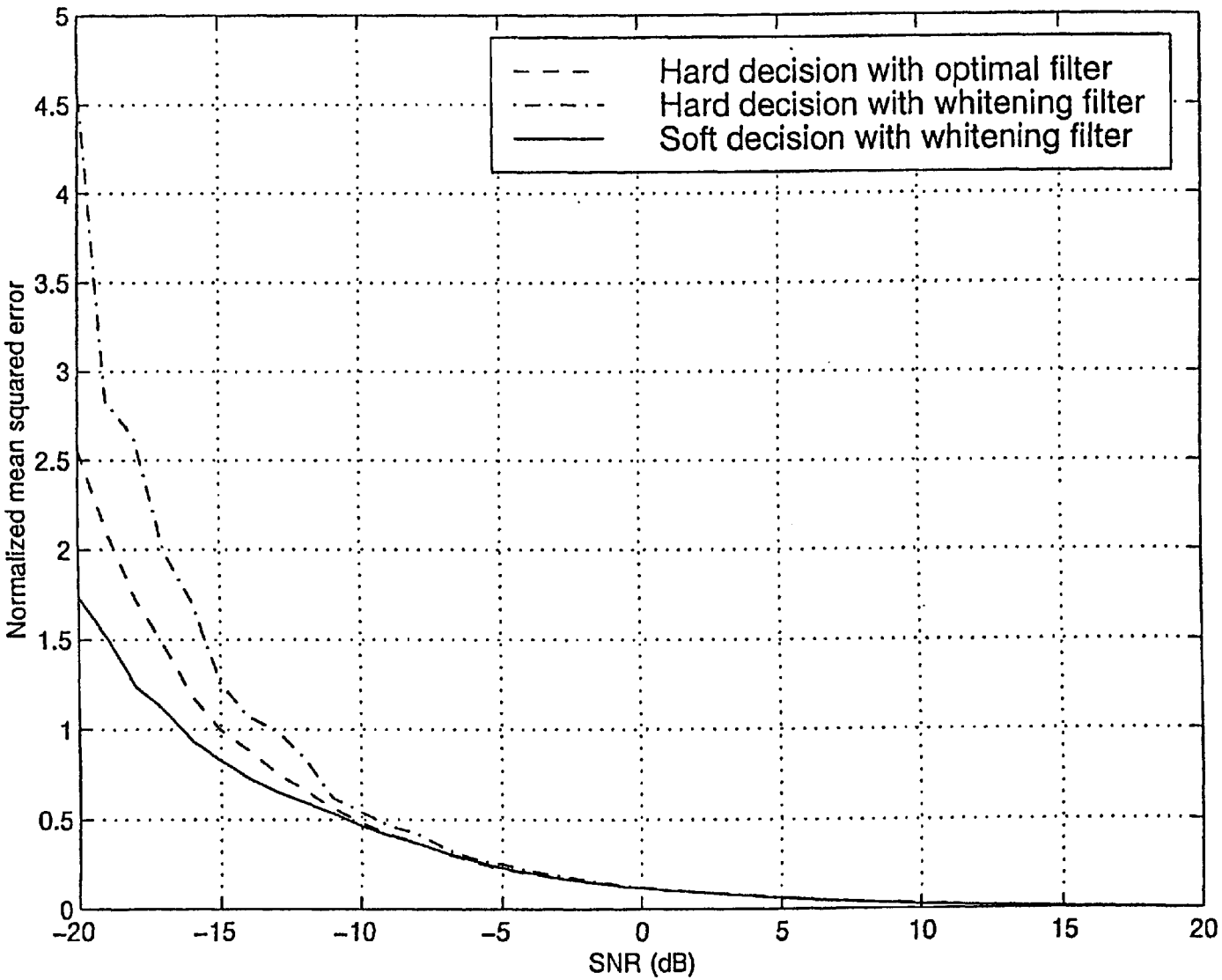
FIG. 5 is a graph comparing the performance of the signal detector of the present invention to a conventional signal detector.

FIG. 5 is a graph comparing the performance of the signal estimation system of the present invention to a conventional hard decision signal estimation system. In the comparison, two VAD filters, the high-complexity optimal filter and the whitening filter, are used for hard decision estimation while, in the soft decision approach, only the whitening filter is used. As shown in the graph, the soft decision signal estimation system 100 with whitening filter outperforms the hard decision approach even when the VAD filter is optimal. At low signal to noise ratios, the soft decision system improves the output results significantly, while at high signal to noise ratios, the results are very close to each other. It is important to note that VAD filter 112 for the soft decision signal estimation system is relatively simple which is much simpler to implement that the optimal VAD filter used in the conventional hard decision signal estimation system.

What is claimed is:

1. A method for estimating a speech signal contained within a received signal including both a speech component and a noise component, said method comprising:

a) inputting the received signal to a receiver filter and a voice activity detector;

b) computing a likelihood ratio within said voice activity detector based on the power of said received signal;

c) computing a speech probability estimate within said voice activity detector based on said likelihood ratio and the a priori probability of speech;

d) outputting said speech probability estimate from said voice activity detector;

d) filtering said received signal within said receiver filter to obtain a filter output signal; and e) combining said filter output signal with said speech probability estimate output from said voice activity detector to produce a soft estimate of said speech signal.

2. The method according to claim 1 wherein computing a likelihood ratio includes filtering the received signal in a voice detection filter, generating a power estimate based on said filter output, and computing said likelihood ratio based on said power estimate.

3. The method according to claim 2 wherein said voice detection filter is a whitening filter.

4. The method according to claim 1 wherein said receiver filter is a Wiener filter.

5. The method according to claim 1 further including computing the power spectral density of said noise component and said received signal, and adjusting the frequency response of said receiver filter based on said power spectral densities.

6. The method according to claim 5 further including updating the power spectral density of said noise component when said likelihood ratio is below a predetermined threshold.

7. The method according to claim 6 further including updating the power spectral density of said received signal when said likelihood ratio is below a predetermined threshold.

8. The method according to claim 1 further including computing the power spectral density of said noise component of said received signal, and adjusting the frequency response of said voice detection filter based on said power spectral density of said noise component.

9. The method according to claim 8 further including updating the power spectral density value of said noise component when said likelihood ratio is below a predetermined threshold.

10. A method for estimating a speech signal contained within a received signal including both a speech component and a noise component, said method comprising:

a) computing a likelihood ratio based on the power of said received signal;

b) computing a speech probability estimate based on said likelihood ratio and the a priori probability of speech;

c) filtering said received signal with a receiver filter to obtain a filter output signal; and d) combining said filter output signal with said speech probability estimate to produce a soft estimate of said speech signal.

11. The method according to claim 10 wherein said receiver filter is a Wiener filter.

12. The method according to claim 10 further including computing the power spectral density of said noise component and said received signal, and adjusting the frequency response of said receiver filter based on said power spectral densities.

13. The method according to claim 12 further including updating the power spectral density of said noise component when said likelihood ratio is below a predetermined threshold.

14. The method according to claim 13 further including updating the power spectral density of said received signal when said likelihood ratio is below a predetermined threshold.

15. The method according to claim 10 wherein computing a likelihood ratio includes filtering the received signal in a voice detection filter, generating a power estimate based on said filter output, and computing said likelihood ratio based on said power estimate.

16. The method according to claim 15 wherein said voice detection filter is a whitening filter.

17. The method according to claim 15 further including computing the power spectral density of said noise component of said received signal, and adjusting the frequency response of said voice detection filter based on said power spectral density of said noise component.

18. The method according to claim 17 further including updating the power spectral density of said noise component when said likelihood ratio is below a predetermined threshold.

19. A soft-decision signal detector for producing a soft estimate of a received speech signal contained in a received signal including both speech and noise components, said signal detector comprising:

a) a voice activity detector for producing a speech probability estimate indicative of the probability of speech being present in said received signal, said voice activity detector including:

1) a voice detection filter for producing a filtered output based on said received signal;

2) a power detector connected to said voice detection filter to calculate a power estimate based on the output of said voice detection filter;

3) a likelihood estimator connected to said power detector to calculate a likelihood ratio based on said power estimate;

4) a speech probability estimate connected to said likelihood calculator to calculate said speech probability estimate based on said likelihood ratio;

b) a receiver filter to filter said received signal and produce a filtered output signal; and c) a signal combiner for combining said filter output signal and said speech probability estimate to obtain a soft estimate of said speech signal.

20. The signal detector according to claim 19 further including a power spectral density calculator for calculating the power spectral density of said noise component and said received signal.

21. The signal detector according to claim 20 wherein the power spectral densities computed by said power spectral density calculator are used to adjust the frequency response of said receiver filter.

22. The signal detector according to claim 20 wherein the power spectral densities computed by said power spectral density calculator are used to adjust the frequency response of said voice detection filter.

23. The signal detector according to claim 20 wherein said power spectral density calculator updates said power spectral density of the noise component when said likelihood ratio is below a predetermined threshold.

24. The signal detector according to claim 20 wherein said power spectral density calculator updates said power spectral density of the received signal when said likelihood ratio is above a predetermined threshold.

* * * * *